US005482592A

United States Patent [19]

Boriani et al.

[11] Patent Number: 5,482,592

[45] Date of Patent: Jan. 9, 1996

[54] METHOD AND DEVICE FOR SPLICING NARROW STRIPS

[75] Inventors: Silvano Boriani; Alessandro Minarelli, both of Bologna, Italy

[73] Assignee: G.D Societa' Per Azioni, Bologna, Italy

[21] Appl. No.: 248,335

[22] Filed: May 24, 1994

[30] Foreign Application Priority Data

Jun. 4, 1993 [IT] Italy ..... BO93A0261

[51] Int. Cl.[6] ..... B65H 21/00

[52] U.S. Cl. ..... 156/505; 156/157; 156/159; 156/504; 242/552; 242/556.1

[58] Field of Search ..... 156/157, 159, 156/504, 505; 242/552, 555.2, 556.1

[56] References Cited

U.S. PATENT DOCUMENTS

| | | | |
|---|---|---|---|
| 2,475,351 | 7/1949 | Castay | 156/507 X |
| 2,506,933 | 5/1950 | Mercer | 156/505 X |
| 3,061,220 | 10/1962 | Gagg et al. | 156/504 X |
| 3,607,572 | 9/1971 | Jorgensen | 156/505 |
| 3,716,444 | 2/1973 | Hanke | 156/505 |
| 3,833,447 | 9/1974 | Gustafson . | |
| 3,914,491 | 10/1975 | Takahashi | 156/505 X |
| 4,097,323 | 6/1978 | De Roeck et al. | 242/555.2 X |
| 4,247,582 | 1/1981 | Hanke . | |
| 4,840,694 | 6/1989 | Brookman et al. | 156/157 X |
| 4,878,982 | 11/1989 | Ogata et al. | 156/159 X |
| 5,326,419 | 7/1994 | Boriani et al. | 156/504 X |
| 5,354,408 | 10/1994 | Otomine et al. | 156/505 |

FOREIGN PATENT DOCUMENTS

| | | |
|---|---|---|
| 604298 | 7/1948 | United Kingdom . |
| 1000886 | 8/1965 | United Kingdom . |

*Primary Examiner*—Mark A. Osele
*Attorney, Agent, or Firm*—Ladas & Parry

[57] ABSTRACT

A method and device for splicing narrow strips, whereby a first portion of a first strip is superimposed on a second portion of a second strip; and an adhesive connecting element is folded in a U about the strip portions.

12 Claims, 4 Drawing Sheets

METHOD AND DEVICE FOR SPLICING NARROW STRIPS

BACKGROUND OF THE INVENTION

The present invention relates to a method of splicing narrow strips.

Here and hereinafter, the term "narrow strip" is intended to mean a strip of film material of one or a few millimeters in width.

The present invention may be used to advantage, though in no way exclusively, on machines employing narrow strips fed off a reel, for splicing two strips and switching automatically or semiautomatically from a runout reel to a new reel.

In the following description, specific reference is made, purely by way of example, to the above application.

On machines employing reels of normal strip material, changeover from the runout reel to a new reel is normally effected automatically by means of a reel change device which provides for fly-splicing the trailing end of the strip on the runout reel to the leading end of the strip on the new reel.

The two strips are normally spliced using an adhesive connecting element which is applied to the two adjacent aligned surfaces of the runout strip and new strip respectively.

Though valid for applications involving relatively wide strips, the above method is unreliable for splicing narrow strips such as the "tear-off" strips of packets in general, and packets of cigarettes in particular, in which case the splices made as described above are invariably weak and tend to fail even under the pull exerted on the strips as they are reeled off.

SUMMARY OF THE INVENTION

It is an object of the present invention to provide a method of splicing narrow strips, designed to overcome the aforementioned drawback.

According to the present invention, there is provided a method of splicing narrow strips; characterized in that it comprises stages consisting in superimposing a first portion of a first strip on a second portion of a second strip; and folding an adhesive connecting element in a U about the superimposed strip portions.

The above method preferably comprises stages consisting in connecting a first portion of said adhesive element to a first surface of said second strip portion, so that the adhesive element presents a second portion projecting transversely in relation to the second strip portion; superimposing said first strip portion on the second strip portion, so that a third surface of the first strip portion contacts a second surface, opposite said first surface, of the second strip portion; and folding said second portion of the adhesive element on to a fourth surface, opposite said third surface, of said first strip portion.

The present invention also relates to a device for splicing narrow strips.

According to the present invention, there is provided a device for splicing narrow strips, the device comprising a splicing station for splicing a first portion of a first strip and a second portion of a second strip; first feed means for feeding said first and second strip portions, arranged one on top of the other, to the splicing station; and second feed means for feeding an adhesive connecting element to the splicing station; characterized in that it comprises folding means for folding the adhesive element in a U about said superimposed first and second strip portions.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 7, 8:
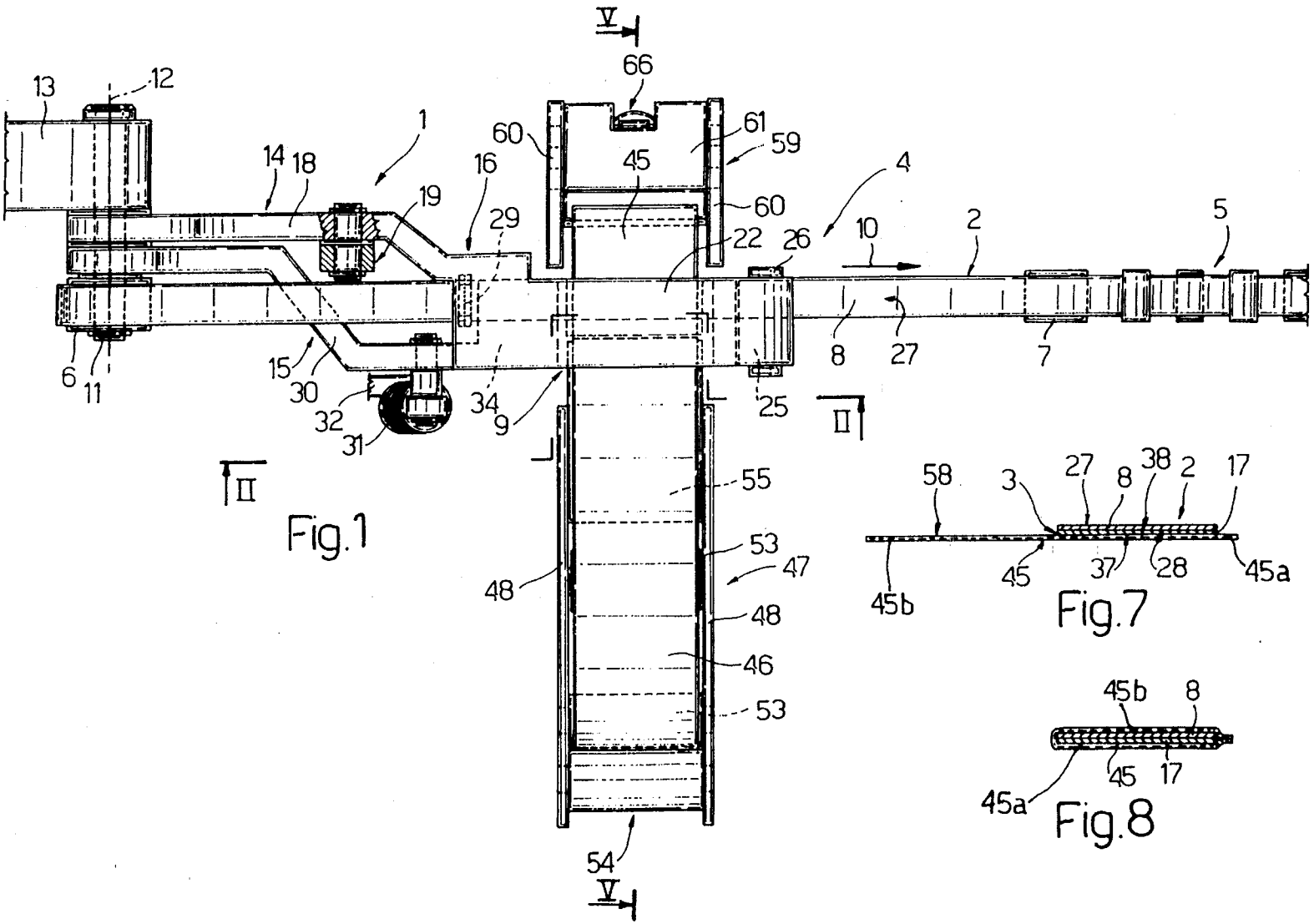
FIG. 1 shows a plan view of a preferred embodiment of the device according to the present invention.
FIG. 7 shows an enlarged view of a detail in FIG. 5.
FIG. 8 shows an enlarged view of a detail in FIG. 6.
Figure 9:
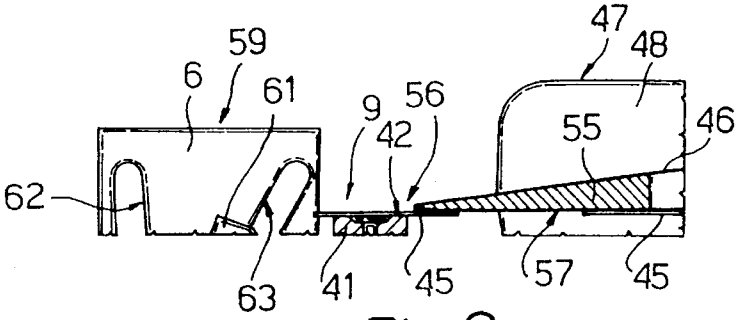
FIG. 9 shows a detail of FIG. 5 in a different operating position.

Number 1 in FIG. 1 indicates a device for splicing two narrow strips 2 and 3. Device 1 forms part of a unit 4 for continuously feeding strip 2 to a user machine (not shown), and comprising, in addition to device 1, a known variable-capacity store 5 through which is fed a portion of varying length of strip 2.

Device 1 is supplied with strip 2 from a reel (not shown), and comprises a first and second guide roller 6 and 7 for supporting a portion 8 of strip 2 facing a splicing station 9 upstream from store 5 in the traveling direction 10 of strip 2.

Figure 2:
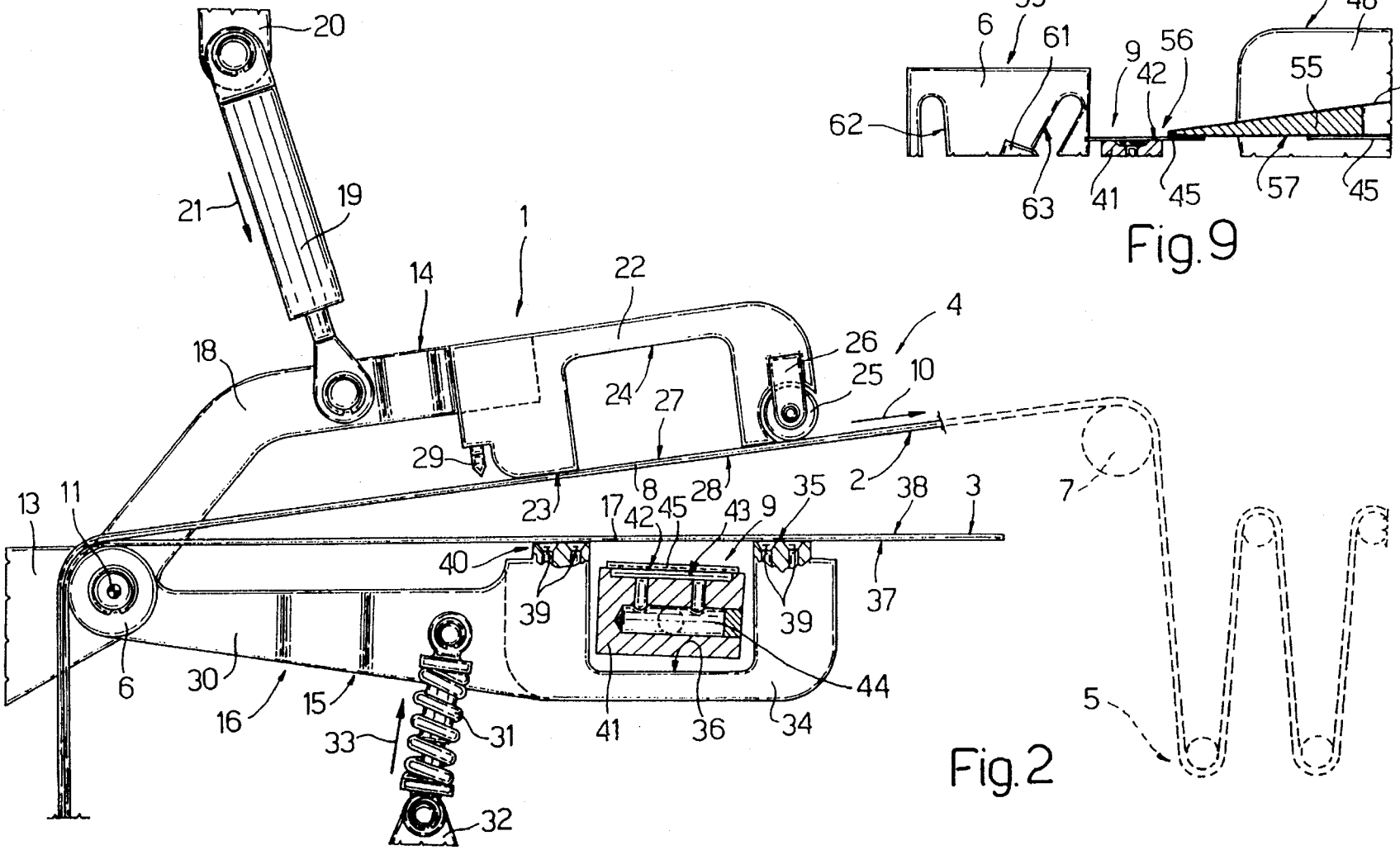
FIG. 2 shows a section, with parts removed for clarity, along line II—II in FIG. 1.

Roller 6 is mounted idly on a pin 11 having an axis 12 perpendicular to direction 10 and the FIG. 2 plane, and fitted to a fixed bracket 13. By means of pin 11, bracket 13 supports for rotation, about axis 12, two jaws 14 and 15 of a gripping device 16 forming part of device 1 and which provides for supporting a fixed end portion 17 of strip 3 facing station 9 and wound about roller 6 between roller 6 itself and strip 2; for superimposing portion 8 of strip 2 on portion 17; and for transversely feeding portions 8 and 17 into station 9.

As shown more clearly in FIG. 2, jaw 14 of device 16 is located on the opposite side of portions 8 and 17 to jaw 15, and comprises a substantially Z-shaped arm 18 hinged at one end to pin 11 and rotated about axis 12 by a jack 19. Jack 19 is located between an intermediate point of arm 18 and a fixed bracket 20, and moves towards station 9 in a direction 21 perpendicular to axis 12 and substantially perpendicular to portion 8 of strip 2. Jaw 14 also comprises a block 22 substantially in the form of a rectangular parallelepipedon, integral with the free end of arm 18, and defined, on the side facing portion 8, by a substantially flat surface 23. Surface 23 presents an intermediate cavity 24, and is defined at the front, in direction 10, by a roller 25 fitted to a bracket 26 so as to rotate about an axis parallel to axis 12, and in contact with the surface 27 of strip 2 opposite the surface 28 of strip 2 facing portion 17 of strip 3. On the side facing arm 18, block 22 supports a knife 29 perpendicular to surface 23 and for cutting strip 2.

Again as shown in FIG. 2, jaw 15 of device 16 comprises a substantially Z-shaped arm 30 hinged at one end to pin 11, alongside arm 18, and rotated about axis 12 in opposition to the thrust exerted by a spring 31 located between an intermediate point of arm 30 and a fixed bracket 32, and acting in a direction 33 perpendicular to axis 12 and substantially perpendicular to portion 17 of strip 3. Jaw 15 also comprises a block 34 substantially in the form of a rectangular parallelepipedon, connected integral with the free end of arm 30, and facing surface 23 of block 22, on the opposite side of portions 8 and 17 to block 22. On the side facing portion 8, block 34 is defined by a substantially flat surface 35 which presents an intermediate cavity 36 facing cavity 24, and contacts the surface 37 of portion 17 of strip 3 opposite the surface 38 of portion 17 facing portion 8 of strip 2. To the front and rear of cavity 36 in direction 10, surface 35 presents the suction inlets 39 of a stop device 40 for retaining portion 17 of strip 3 in a fixed position contacting surface 35 and across and substantially closing cavity 36.

As shown in FIG. 2, splicing station 9 is defined by a platform 41 housed entirely inside cavity 36 and supported in a fixed position by a frame (not shown). On the side facing jaw 14, platform 41 presents a flat surface 42 substantially parallel to, and, when idle, withdrawn in relation to, surface 35. Surface 42 presents inlet grooves 43 of a suction device 44 for retaining on surface 42 substantially rectangular adhesive labels 45 supported on a nonadhesive strip 46 and fed successively to station 9 by a feed device 47 shown in detail in FIGS. 5 and 6.

Figure 5:
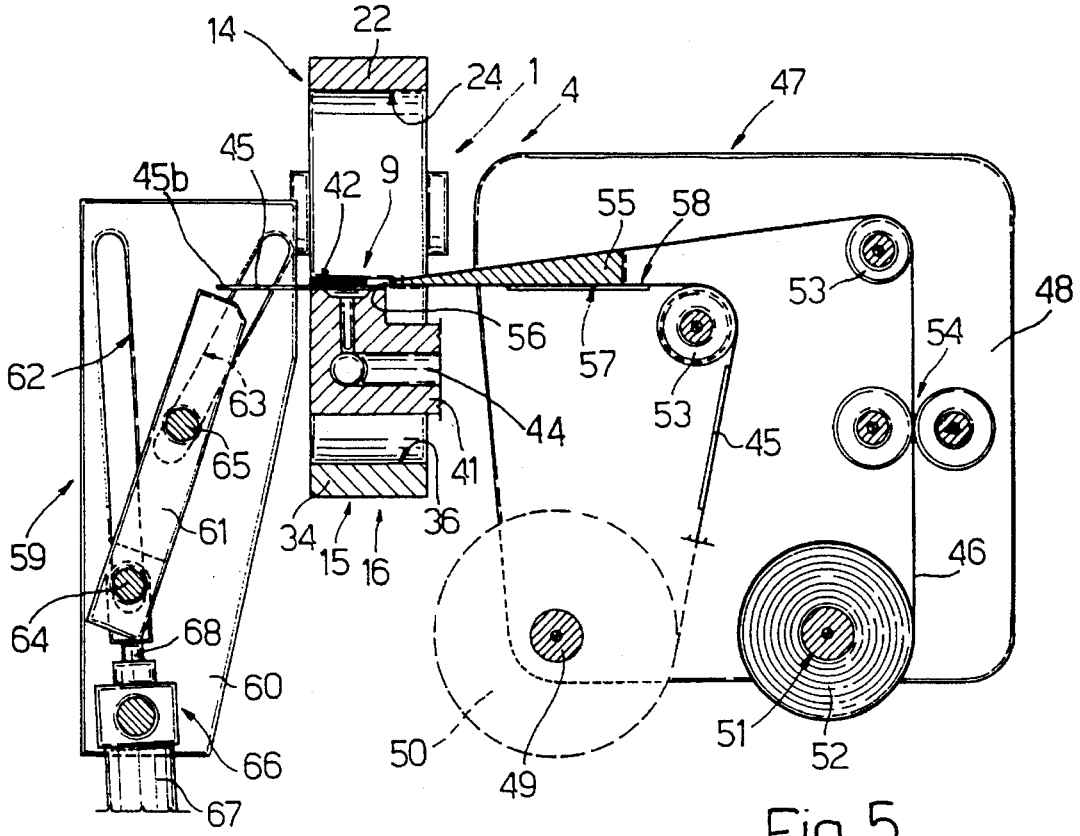
FIG. 5 shows a section along line V—V in FIG. 1.
Figure 6:
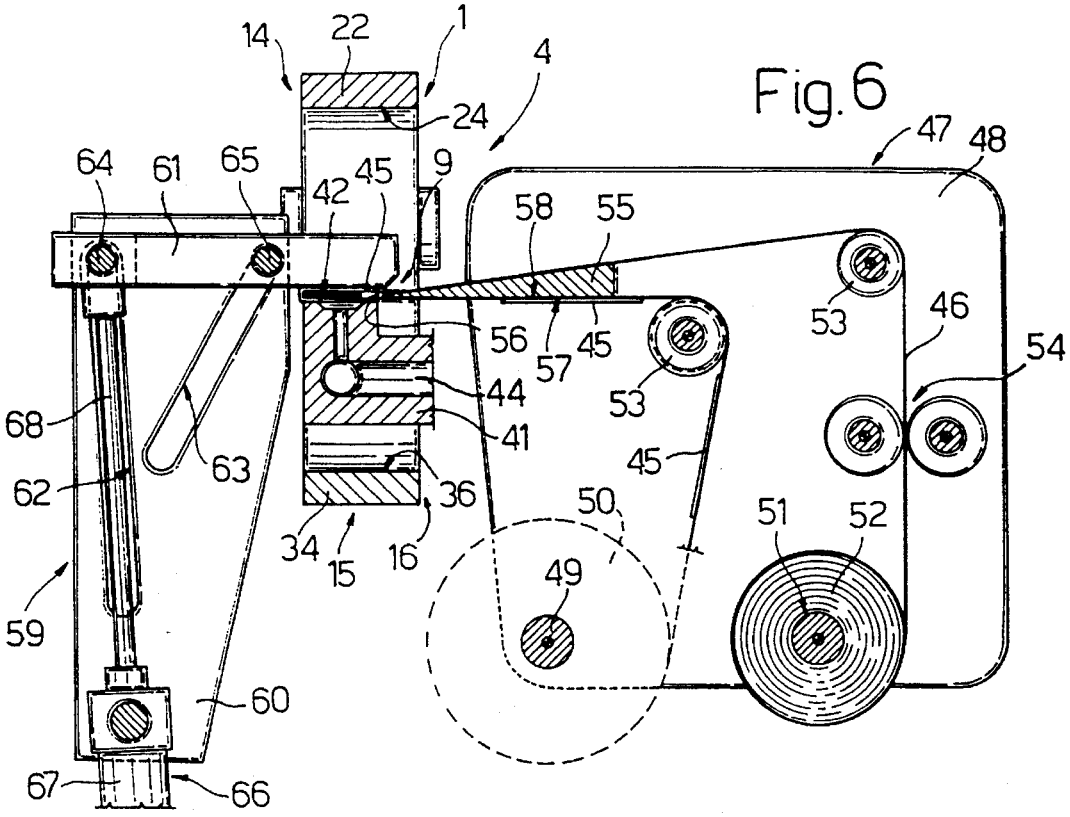
FIG. 6 shows the same view as in FIG. 5, of the FIG. 1 device in a different operating position.

With reference to FIGS. 5 and 6, device 47 comprises two fixed plates 48 located to the side of gripping device 16, parallel to axis 12 and perpendicular to portions 8 and 17 of strips 2 and 3, and fitted in between with a pin 49 perpendicular to axis 12 and to plates 48 and supporting a reel 50 of strip 46. In between, plates 48 also support a winding device 51 for the takeup reel 52 of strip 46 unwound off reel 50; two guide rollers 53 parallel to pin 49; a traction device 54 with rollers parallel to rollers 53; and a wedge-shaped plate 55 located to the side of platform 41, just above roller 53 adjacent to pin 49, and projecting outwards of the gap between plates 48. Plate 55 presents, at its free end, an apex 56 substantially parallel to direction 10 and adjacent to platform 41, and is defined, on the side facing pin 49, by a flat surface 57 adjacent to apex 56, substantially coplanar with surface 42 of platform 41, and along which strip 46 is fed and wound, in use, about apex 56.

Strip 46 supports labels 45 with their adhesive surface 58 connected to the opposite surface of strip 46 to that running along surface 57, so that, as the portion of strip 46 supporting label 45 winds about apex 56, label 45 is gradually detached from strip 46 and deposited onto surface 42. As shown in FIGS. 5 and 7, label 45 is so sized that, when fully detached from strip 46, a first half **45*a* of label 45 lies on surface 42 where it is retained by suction device 44; while a second half 45*b* of label 45 projects beyond surface 42, on the opposite side of platform 41 to feed device 47, where it is engaged by a folding device 59 for folding second half 45*b* by 180° onto respective first half 45*a***.

As shown particularly in FIGS. 5 and 6, folding device 59 comprises two flat parallel plates 60 facing each other and each coplanar with a respective plate 48 (FIG. 1), and between which is housed a movable, substantially rectangular folding plate 61 extending perpendicular to plates 60.

Plates 60 present respective pairs of straight slots 62 and 63 facing each other and engaged in sliding manner by the opposite ends of respective pins 64 and 65 fitted through and integral with plate 61. More specifically, pin 64 is fitted through one end of plate 61 and engages in sliding manner both slots 62, which extend in a direction substantially perpendicular to the plane of surface 42, and intersect said plane so that one end of slots 62 projects beyond the plane, while the remaining portion extends on the same side of the plane as jaw 15, and over substantially the whole length of respective plates 60. Pin 65, on the other hand, is fitted through an intermediate portion of plate 61, and engages in sliding manner both slots 63, each of which is formed in the half of respective plate 60 extending through the plane of surface 42. More specifically, each slot 63 presents one end adjacent to an intermediate point of respective slot 62, and diverges from slot 62 towards the plane of surface 42, so as to project beyond said plane at the other end, and form, with slot 62, an angle of less than 90° and, in the example, of roughly 50°.

Again with reference to FIGS. 5 and 6, plate 61 is moved in relation to plates 60 by a jack 66, the body 67 of which pivots between plates 60, and the rod 68 of which is hinged to plate 61 at pin 64, so as to move plate 61 between a first idle position (FIG. 5) wherein plate 61 extends entirely on the same side of the plane of surface 42, facing the half **45*b* of label 45 projecting beyond surface 42, and a second operating position (FIG. 6) wherein plate 61 extends entirely on the other side of the plane of surface 42, parallel to surface 42, and with its free end portion facing and adjacent to platform 41**.

Operation of unit 4 in general, and of device 1 in particular, will now be described as of the condition shown in FIG. 2, wherein gripping device 16 is maintained by jack 19 in the open position with jaw 14 raised, and jaw 15 maintained in the raised substantially horizontal idle position by spring 31; strip 2 is fed at constant speed through unit 4 and contacting surface 23 and roller 25; and strip 3 extends about roller 6, beneath strip 2, and is maintained stationary by device 40, with portion 17 contacting surface 35 and extending across cavity 36. In this position, portion 17 is arranged facing and just clear of surface 42 of platform 41 housed in a fixed position inside cavity 36, and diverges from portion 8 of strip 2 as of roller 6.

As of the above condition, upon the strip 2 reel (not shown) nearing the end, device 47, as described previously, is activated to feed and deposit a label 45 with half **45*b* retained on platform 41 by suction device 44, and half 45*b* projecting from platform 41 towards folding device 59**.

Figure 3:
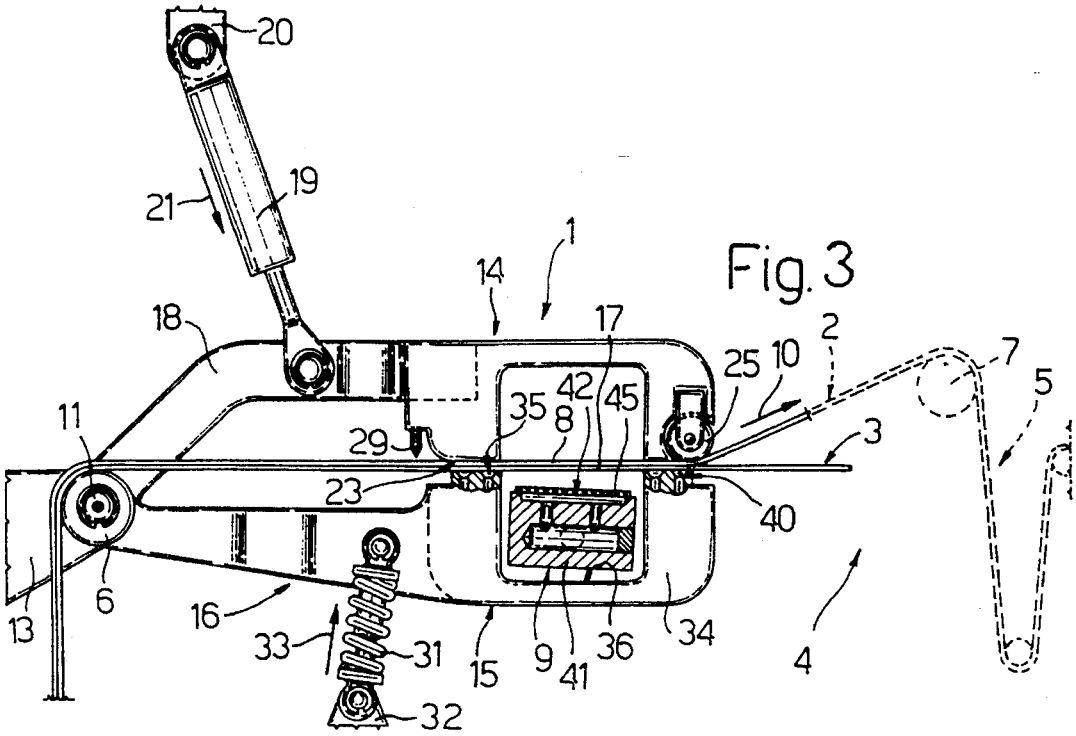
FIGS. 3 and 4 show the same view as in FIG. 2, of the FIG. 2 device in two different operating positions.
Figure 4:
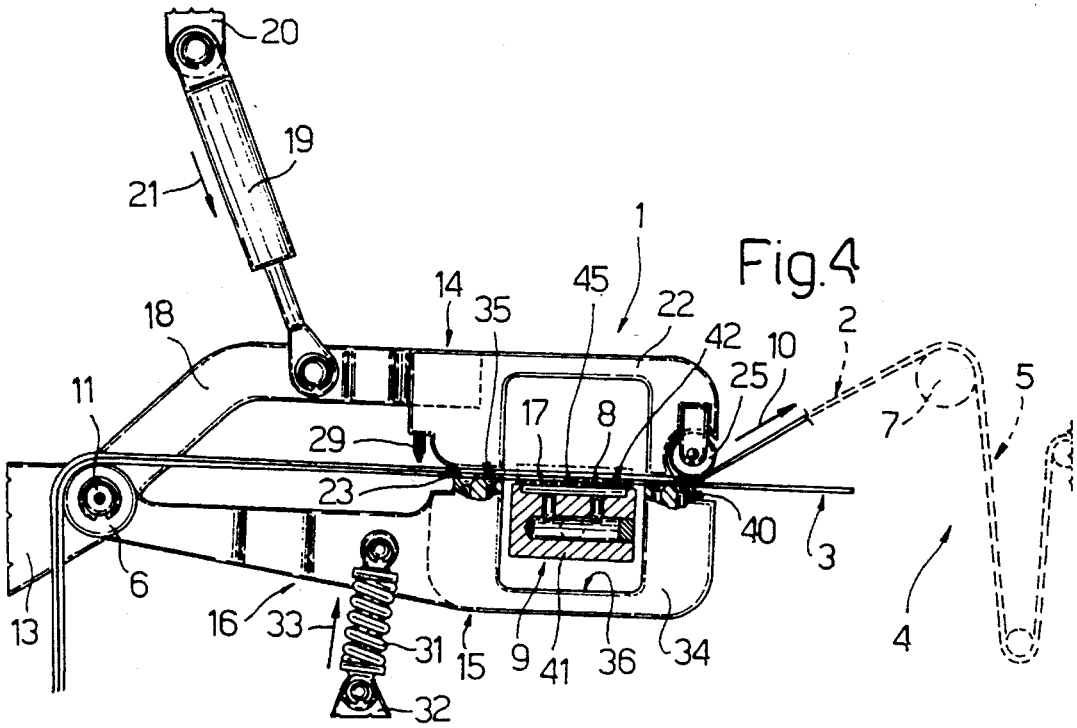

Operation of jack 19 at this point provides firstly for moving jaw 14 towards jaw 15 so as to set gripping device 16 to the closed position (FIG. 3) wherein surfaces 28 and 38 of portions 8 and 17 are arrested contacting each other, and strip 2 is absorbed by store 5 and cut by knife 29; and secondly for moving both jaws 14 and 15, against the action of spring 31, so that (FIG. 4) surface 37 of portion 17 contacts the adhesive surface 58 of half **45*a* of label 45 lying on platform 41**.

At this point, jack 66 is activated to move plate 61 gradually from the idle to the operating position, in the course of which, plate 61 cooperates with label 45 and folds it gradually in a U so that half **45*b* adheres to surface 27 of portion 8 and so grips portions 8 and 17 together between halves 45*a* and 45*b* for firmly splicing the trailing end portion 8 of strip 2 and the leading end portion 17 of strip 3**.

Upon jack 19 being deactivated, strips 2 and 3 are released, and strip 3 then unwound normally.

What is claimed is:

1. A device for splicing narrow strips, the device comprising a splicing station for splicing a first portion of a first strip and a second portion of a second strip; first feed means for feeding said first and second strip portions, arranged one on top of the other, to the splicing station; second feed means for feeding an adhesive connecting element to the splicing station; and folding means for folding the adhesive element in a U shape about the superimposed first and second strip portions; said first feed means comprising a gripping device including first and second jaws movable both towards each other to grip said portions of the strips on top of and in unison with each other and in relation to the splicing station for feeding the two strips to the splicing station.

2. A device as claimed in claim 1, wherein said second jaw presents a cavity housing said splicing station.

3. A device as claimed in claim 2, further comprising stop means on said second jaw for releasably retaining the second portion of said second strip contacting the second jaw and substantially closing said cavity.

4. A device as claimed in claim 1, wherein said first feed means comprises linear actuating means connected to the first jaw for moving the first jaw towards the second jaw; and elastic reaction means connected to the second jaw and acting towards the first jaw.

5. A device as claimed in claim 1, further comprising cutting means on said first jaw for transversely cutting said first strip.

6. A device as claimed in claim 1, wherein said splicing station comprises a platform; and retaining means for releasably retaining a portion of said adhesive element contacting said platform.

7. A device as claimed in claim 1, wherein said folding means comprises one folding plate; guide means for guiding the folding plate; and actuating means connected to the folding plate; for moving the folding plate along the guide means; said guide means comprising a first and second fixed guide; the folding plate having first and second slide elements connected in rotary and sliding manner to said first guide and said second guide respectively.

8. A device as claimed in claim 7, wherein said actuating means comprises one jack connected to said first slide for moving said first slide along said first guide.

9. A device as claimed in claim 8, wherein one of said first and second slides is connected to the end opposite the operating end of the folding plate, and the other slide is connected to an intermediate point of the folding plate.

10. A device as claimed in claim 9, wherein said guides are coplanar and straight, and form an angle of other than zero in relation to each other.

11. A device as claimed in claim 8, wherein said guides are coplanar and straight, and form an angle of other than zero in relation to each other.

12. A device as claimed in claim 7, wherein said guides are coplanar and straight, and form an angle of other than zero in relation to each other.

* * * * *